US010052883B2

(12) United States Patent
Liao et al.

(10) Patent No.: US 10,052,883 B2
(45) Date of Patent: Aug. 21, 2018

(54) MOBILE PRINTING

(71) Applicant: Hewlett-Packard Development Company, L.P., Houston, TX (US)

(72) Inventors: Andy Liao, San Diego, CA (US); Vijaykumar Nayak, San Diego, CA (US); John T. Brassil, Princeton, NJ (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/547,290

(22) PCT Filed: Jan. 30, 2015

(86) PCT No.: PCT/US2015/013968
§ 371 (c)(1),
(2) Date: Jul. 28, 2017

(87) PCT Pub. No.: WO2016/122661
PCT Pub. Date: Aug. 4, 2016

(65) Prior Publication Data

US 2018/0001660 A1 Jan. 4, 2018

(51) Int. Cl.
*B41J 3/36* (2006.01)
*B41J 29/393* (2006.01)

(52) U.S. Cl.
CPC ..... *B41J 3/36* (2013.01); *B41J 29/393* (2013.01)

(58) Field of Classification Search
CPC ..... B41J 3/36; B41J 29/393
See application file for complete search history.

(56) References Cited

U.S. PATENT DOCUMENTS 5,132,702 A 7/1992 Shiozaki et al.
6,942,402 B1 9/2005 Slupe et al.
(Continued)

FOREIGN PATENT DOCUMENTS

CN 101668642 3/2010
CN 101675655 3/2010
(Continued)

OTHER PUBLICATIONS

Inkjet Printer Positioning System, Society of Robots/Robot Forum, http://www.societyofrobots.com/robotforum/index.php?topic=190.0, Oct. 16, 2006.

*Primary Examiner* — Bradley Thies
(74) *Attorney, Agent, or Firm* — Dicke, Billig & Czaja, PLLC

(57) ABSTRACT

A mobile printing system including a handheld printing device including at least two navigation sensors, a transmitter, a processor, and a print nozzle, and a distance sensing module including at least two distance sensors, the distance sensing module to be mountable to a print media at a distance from the handheld printing device, the distance sensing module to sense positional data of the handheld printing device, wherein the processor determines current, past, and anticipated positions of the handheld printing device based on positional data information received from the distance sensing module and navigation information received from the at least two navigation sensors and controls the handheld printing device to cause print fluid to be dispensed according to a print request and the anticipated positions of the handheld printing device.

15 Claims, 4 Drawing Sheets

(56) References Cited

U.S. PATENT DOCUMENTS

| | | | | |
|---|---|---|---|---|
| 7,336,388 | B2 | 2/2008 | Breton | |
| 7,661,814 | B2 | 2/2010 | Noe et al. | |
| 7,787,145 | B2 | 8/2010 | Robertson et al. | |
| 8,077,350 | B1 | 12/2011 | Simmons | |
| 8,342,627 | B1 | 1/2013 | Bledsoe et al. | |
| 8,622,539 | B2 | 1/2014 | Schwartz et al. | |
| 2004/0036725 | A1 | 2/2004 | Ikeda et al. | |
| 2007/0150194 | A1 | 6/2007 | Chirikov | |
| 2007/0248367 | A1 | 10/2007 | Fuchs | |
| 2012/0136620 | A1 | 5/2012 | Mealy et al. | |
| 2012/0293580 | A1* | 11/2012 | Bledsoe | B41J 3/36 347/14 |
| 2012/0300006 | A1 | 11/2012 | Mealy et al. | |
| 2013/0257984 | A1 | 10/2013 | Beier et al. | |
| 2013/0286073 | A1 | 10/2013 | Blessing et al. | |

FOREIGN PATENT DOCUMENTS

| | | |
|---|---|---|
| CN | 101983130 | 3/2011 |
| CN | 102637620 | 9/2012 |
| CN | 103356710 | 10/2013 |
| CN | 103459116 | 12/2013 |
| EP | 2131151 | 12/2009 |
| JP | H10-016314 | 1/1998 |
| JP | 2002-333314 | 11/2002 |
| JP | 2005-128611 | 5/2005 |
| JP | 2007-520374 | 7/2007 |
| JP | 2010-522650 | 7/2010 |
| RU | 139571 | 4/2014 |

* cited by examiner

MOBILE PRINTING

BACKGROUND

Imaging devices and, more particularly, image printing systems and methods often include printheads having a fixed travel pattern, such as a desktop printer. For example, a printing process using inkjet technology typically involves moving an inkjet cartridge horizontally along a vertically moving print medium, such as a sheet of paper, and sequentially depositing ink by ejecting ink onto the paper to form an image. Stand-alone printers, whether ink-jet printers or laser jet, typically feed the print medium into the printer, dictating the size of the printer and the type of print medium that can be printed on. The increasing use of portable electronic devices such as cellular phones, tablets, and other handheld computing and other image capturing devices has provided greater demand for mobile printers.

DETAILED DESCRIPTION

In the following detailed description, reference is made to the accompanying drawings which form a part hereof, and in which is shown by way of illustration, specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

A handheld portable printer can be used to print images from cell phones, tablets, and other electronic devices. With the increasing mobility of users having mobile electronic devices, a compact portable printer provides flexibility to print when and where a user desires versus having to wait to until they are able to get to a location with a desktop printer. Printing and motion tracking of printing devices is typically limited to a two-dimensional surface, often, a horizontal surface. Mobile handheld printers can often have poor print quality resulting from difficulty in tracking random movement of the mobile printer on a surface of the print medium. Further, human motor skills are often not precise and consistent in speed or movement pattern and are far less precise than components implemented in desktop printing devices resulting in difficulty in predicting the future movement of the mobile printer. Particularly, handheld or otherwise three dimensionally moveable printers can be difficult to accurately track during the motion of the printer in use and even more difficult to predict future movement of the printer in order to dispense ink at desired locations. A time delay between when the location of the print device is identified to when ink is dispersed onto the print media adds to the issue.

Figure 1:
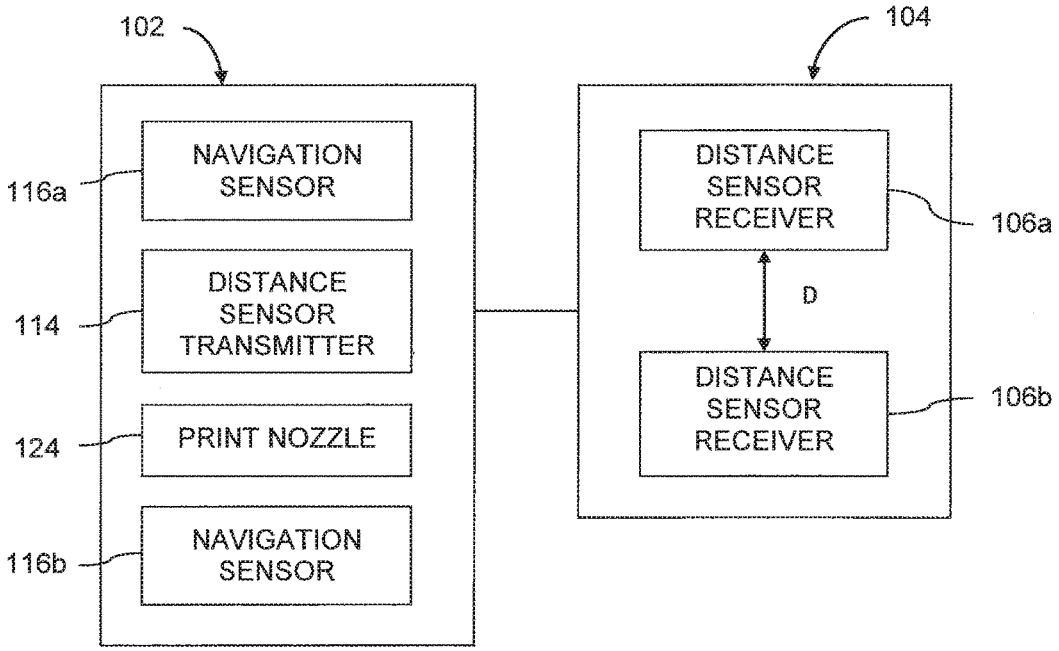
FIG. 1 is a block diagram illustrating an example mobile printing system in accordance with aspects of the present disclosure.

With reference to an example of a mobile printing system 100 illustrated in FIG. 1, mobile printing system 100 includes a printing device 102 and a distance sensing module 104. Printing device 102 is a handheld and hand operated random movement printing device. Distance sensing module 104 is separate and distinct from printing device 102. Distance sensing module 104 includes at least two distance sensor receivers 106*a*, 106*b* positioned at a distance D from one another.

With the above in mind and additional reference to example sensor module 104 illustrated in FIG. 1, distance D between sensor receivers 106*a*, 106*b* is a fixed distance. In one example, distance D is 3.0 inches (7.62 cm) to 4.0 inches (10.16 cm), although other distances are also acceptable. Distance D is fixed as appropriate so to establish a print zone of the desired size while maintaining a compact and portable size of sensor module 104, as discussed further below.

Figure 2:
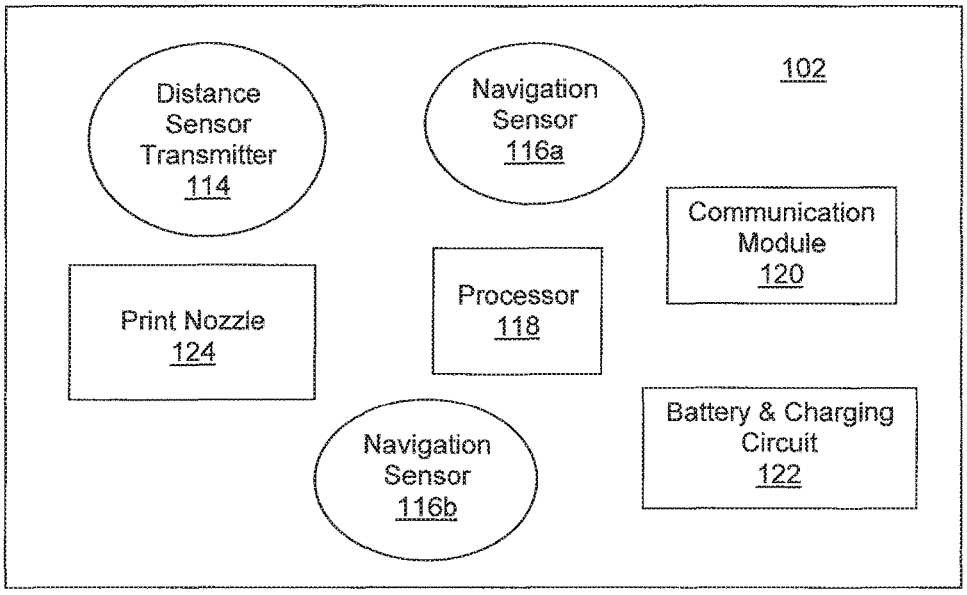
FIG. 2 is a block diagram illustrating an example mobile printing device useful in a mobile printing system in accordance with aspects of the present disclosure.

With reference to FIG. 2, in addition to sensor receivers 106*a*, 106*b*, sensor module 104 includes a microcontroller 108, a rechargeable battery and charging circuit 110, and a communication module 112. Microcontroller 108 is a low power microcontroller, consuming minimal power to extend and maximize the charged life of rechargeable battery 10. Microcontroller 108 executes instructions for operation of sensor module 104. Communication module 112 communicates with a communication module 120 of printing device 102 to transmit positional data detected by sensor receivers 106*a*, 106*b*.

Distance sensor receivers 106*a*, 106*b* can be ultrasonic, optical, or inductive. Distance sensor receivers 106*a*, 106*b* are configured to serve as a reference position and are removably fixed to the print media. Sensor module 104 may be removably coupled to print media using clips, clamps, adhesives, or any other acceptable attachment means (not shown). Distance sensor receivers 106*a*, 106*b* provide a fixed reference and position points with respect to the print media. In the case of ultrasonic distance sensor receivers 106*a*, 106*b*, for example, at least two distance sensor receivers 106*a*, 106*b* are used to triangulate with a transmitter (see, e.g., FIG. 4) included on print device 102 to determine the location/position of print device 102 as discussed in further detail below.

Figure 3:
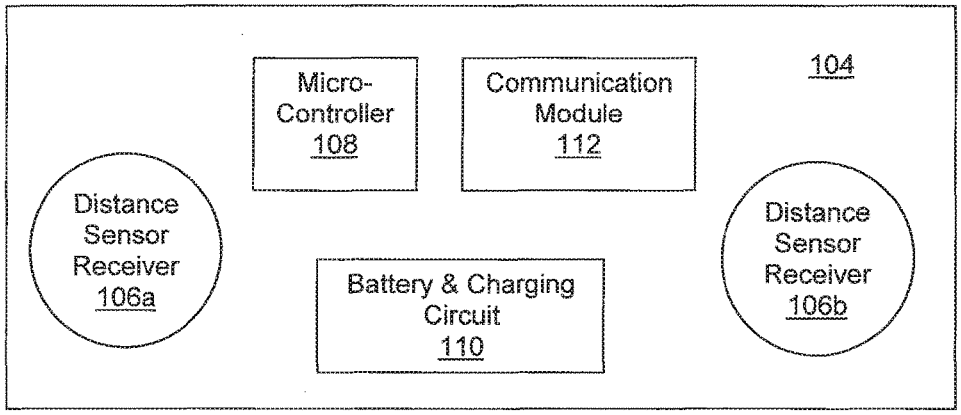
FIG. 3 is a block diagram illustrating an example distance sensor useful in a mobile printing system in accordance with aspects of the present disclosure.

With reference to FIG. 1, and additional reference to an example of printing device 102 illustrated in FIG. 3, printing device 102 includes a distance sensor transmitter 114, navigation sensors 116*a*, 116*b*, and a print nozzle 124. As illustrated in the example printing device 102 of FIG. 3, a processor 118 and a communication module 120 are also included. Communication module 120 communicates with a mobile electronic device, such as a mobile phone, and sensor module 104. A print request can be initiated from a mobile application (app) or operating system (OS) of an electronic device. For example, a mobile application (app) can be downloaded onto the mobile electronic device to enable of the mobile electronic device (e.g., phone) to communicate with printing device 102. Communication module 120 receives image data to be printed from the electronic device, such as a mobile phone. In one example, communication module 120 is a wireless communication module such as a radio frequency (RF) module.

In one example, distance sensor transmitter 114 is used to transmit ultrasound waves that are received by, or detected, distance sensor receivers 106*a*, 106*b* to determine the location of printing device 102. Digital signals of the inherent information from the ultrasound waves received by distance sensor receivers 106*a*, 106*b* is communicated by communication module 112 to communication module 120. From these signals, the location of printing device 102 is determined by processor 118. One or more distance sensor transmitters 114 can be used. In one example, printing device 102 includes a rechargeable battery and charging circuit 122. Other means of powering the device are also acceptable. In one example, printing device 102 includes an on/off switch (not shown) that the user can manipulate to operate or shut down printing device 102 as desired. A print cartridge (not shown) is housed within printing device 102. Print cartridge is removable and replaceable. Print cartridge contains a print material such ink, dye, or other pigment to be dispensed by print nozzles 124.

The print nozzles 124, or printhead, can include rotating nozzles. In other words, print nozzles 124 can rotate in a circular or semi-circular motion when print device 102 is rotated to maintain print nozzle 124 alignment with respect to print device 102 movement and print media. Print nozzles 124 can electro-mechanically align with the print orientation of print device 102 and print media as print device 102 rotates. In one example, the nozzle pattern is a non-linear pattern of nozzles 124. In another example, the nozzle 124 pattern in non-grid like. Nozzles 124 can be offset from one another both in location (i.e., x, y axial distances) on the surface of printing device 102 and positioned at varied angles. As handheld printer 102 provides additional degrees of movement over a fixed printer wherein the print nozzles move along a predetermined path, the rotational movement of printing device 102, for example, makes it difficult to align nozzles 124 with the actual positions where the particular nozzle 124 is to fire/eject ink.

In one example, navigation sensors 116*a*, 116*b* are high speed optical navigation sensors. Printing device 102 includes at least two navigation sensors 116*a*, 116*b*. Navigation sensors 116*a*, 116*b* are positioned at a predetermined, fixed distance from one another on printing device 102. Navigation sensors 116*a*, 116*b* transmit/communicate position data, including rotation, of printing device 102 as it is moved over print media to processor 118. Processor 118 controls print nozzles 124 to dispense ink or other pigment onto print media.

Figure 4:
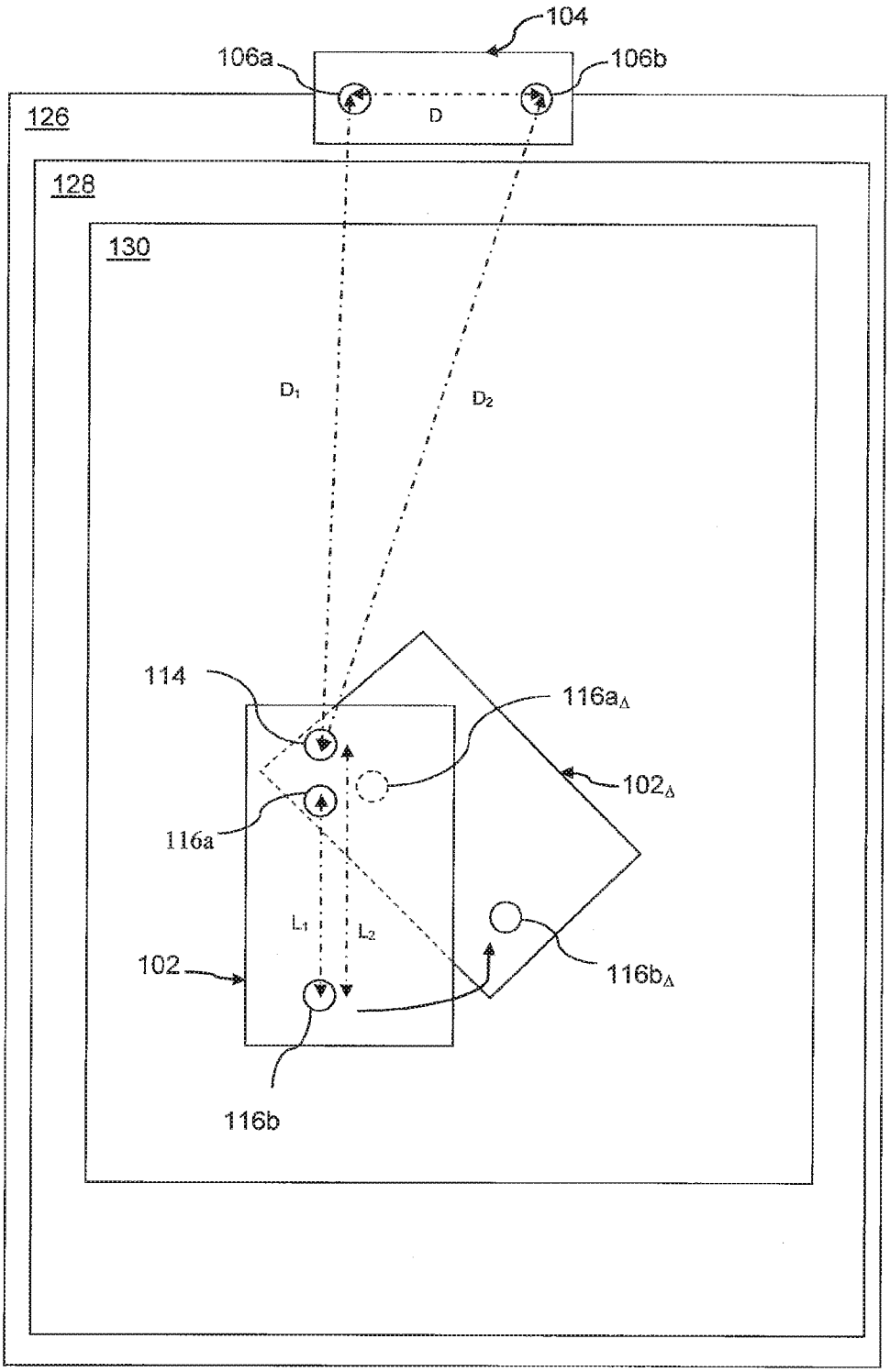
FIG. 4 is a diagrammatic illustration of a mobile printing system on a print media in accordance with aspects of the present disclosure.

With additional reference to FIG. 4, processor 118 can determine the rotation angle, speed, and acceleration of printing device 102 as it is moved across a print media 126 from the data detected by each navigation sensor 116*a*, 116*b*. Processor 118 can use data signals using the distance data detected by each receiver 106*a*, 106*b* relative to the fixed distance sensor transmitter 114 to triangulate the absolute position of print device 102 within a distance sensor detection zone 128. With the combined use of distance sensing receivers 106*a*, 106*b* and navigation sensors 116*a*, 116*b*, processor 118 can accurately determine the rotation angle, speed, and acceleration of print device 102 as a user moves print device 102 within a print zone 130 defined within the borders of print media 126. Also, with the combined use of distance sensing receivers 106*a*, 106*b* and navigation sensors 116*a*, 116*b*, the absolute position of print device 102 relative to print media 126 can be determined. In one example, a sub-millimeter range of accuracy and resolution of print device 102 can be determined with a location prediction technique/process. Processor 118 uses techniques to stop and start printing based on the detected and predicted positional data of print device 102. Velocity and acceleration data is used to control when to print. For example, if print device 102 is being moved in a manner that the future movement of print device 102 is not accurately predictable, nozzles 124 in the printhead will be stopped from firing printing material. Also, printing device 102 will temporarily cease depositing printing material onto print media 126 upon sensing printing device 102 exiting print zone 130. Processor 118 determines the return of printing device 102 to print zone 130 and/or return of printing device 102 to an accurately predictable path or prospective movement based on detected positional information by sensors 106, 116 including the location, rotation, speed, and acceleration of printing device 102 and causes nozzles 124 to restart depositing printing material. In this manner, an automatic on/off control of printing is implemented.

The techniques implemented by processor 118 stops print device 102 printing during times that are difficult to accurately predict future positions. For example, when direction of movement or velocity of print device 102 is abruptly changed or stopped, ejection of ink from nozzles 124 is entirely stopped until a constant velocity print phase can be resumed and identified. Position tracking continues, and print device 102 can be repositioned over the area of print media 126 where printing previously stopped, this time at a constant velocity, and printing is resumed. Printing device 102 can be moved in different directions across print media 126. In one example, a regular sweeping motion of printing device 102, for example back-and-forth from left to right, beginning at the top and moving sequentially to the bottom of the print area can be useful in establishing a constant velocity. In one example, the movement of print device 102 across the print media is sweeping, similar to using a painter's brush across media.

System 100 provides a process to determine firing of nozzles 124 based on low acceleration and constant velocity phase of random hand movement of a user. With a handheld print device, the user has flexibility to move the device in various patterns, angles, and device orientations. All print media points that have been printed are tracked by the navigation and distance sensors 106, 116 and recorded in the memory of processor 118. This provides for the printed areas to not be reprinted over a second time and become over saturated in the event that the print device travels over the already printed areas.

With reference to FIG. 4, distance sensing module 104 is configured to be removably coupled to print media 126. Distance D between distance sensor receivers 106*a*, 106*b* establishes a print zone 130. In other words, the larger distance D is between distance sensor receivers 106*a*, 106*b*, the larger print zone 130 is and vice versa. Distance sensor module 104 is removably fixed y a user to print media 126 until printing is complete. Distance sensor module 104 is positioned on print media 126 to generate positional data of printing device 102 across print media 126. Sensor module 104 may be removably coupled to print media 106 using clips, clamps, adhesives, or any other acceptable attachment means. Distance sensing module 104 can be positioned directly on print media 126 within a perimeter boundary or outside of the boundary of print media 126. Regardless, distance sensor receivers 106*a*, 106*b* are positioned in a fixed relationship to one another. With reference to FIG. 4, distance sensor receivers 106*a*, 106*b* establish a distance sensor detection zone 128 in which print zone 130 is included. Distance sensor detection zone 128 can be the same as print zone 130.

As mobile printing device 102 is moved or repositioned on print media 126, the position of mobile printing device 102 is processed in real-time based on navigation sensor 116*a*, 116*b* data. Optical navigation sensors 116*a*, 116*b* can have high resolution and fast position reporting rate, however, navigation sensors 116*a*, 116*b* can have a built in 1-2% error that can accumulate through time, potentially reducing print quality. Periodically, processor 118 reads distance data from distance sensor receivers 106*a*, 106*b* to correct any cumulative error from navigation sensors 116*a*, 116*b*. In one example, data reporting rate for distance sensor receivers 106*a*, 106*b* can be slow to accommodate and cover fast random movements by a user. Processor 118 initially reads mobile printing device's position relative to distance sensor transmitter 114 as well as zeroing navigation sensors 116*a*, 116*b* to an initial position to utilize the positive aspects of both distance sensor receivers 106*a*, 106*b* and navigation sensor 116*a*, 116*b*. Hand movements can be erratic and difficult to predict where the handheld print device will be in elapsed time. The process of system 100 identifies constant velocity phases, where the movement is relatively consistent, such as when using a back-and-forth sweeping motion across the print media, to accurately predict where printing device 102 will be and fire ink during those phases. Processor 118 receives movement data indicative of location changes and orientation changes of printing device 102 and determines location and orientation data of future printing device locations. Processor 118 executes instructions for printing based on the determination.

In one example, if printing device 102 is moved outside print zone 130 established on print media 126, distance data of printing device 102 will not be received by distance sensor receivers 106*a*, 106*b*. In one example, an audio or visual warning can be produced. Additionally, printing can be ceased until printing device 102 is repositioned within print zone 130. A visual display of printing device 102 within print zone 130 can also be displayed on a mobile computing device. The user can determine the print size of an image within print zone 130 as well as the user desired placement of the image (e.g., off-centered, centered) within print zone 130 on the computing device prior to the image being sent to printing device 102.

With continued reference returning to FIG. 4, distance sensor receivers 106*a*, 106*b* are positioned a fixed distance D from one another on the print media 126. Distance sensor transmitter 114 of printing device 102 is initially positioned on print media 126 is a distance D1 from distance sensor 106*a* and a distance D2 from distance sensor 104*b*, establishing a triangulation between distance sensors 106*a*, 106*b* and distance sensor transmitter 114. As printing device 102 is moved or repositioned on print media 126, distances D1 and D2 change, however, distance D remains fixed.

As illustrated in FIG. 4, navigations sensors 116*a*, 116*b* are positioned on printing device 102 at a fixed distance $L_1$ from one another and navigation sensor 116*b* is positioned on printing device 102 at a fixed distance $L_2$ from distance sensor transmitter 114. Navigation sensors 116*a*, 116*b* on printing device 102 detect rotation and orientation of printing device 102 as it is moved or repositioned on print media 126. For example, printing device 102 is originally positioned on print media 126 with navigation sensor 116*a* having coordinates $(X_1, Y_1)$, navigation sensor 116*b* having coordinates $(X_2, Y_2)$, and distance sensor transmitter having coordinates $(X_0, Y_0)$. Upon repositioning printing device 102 in a rotational manner, as indicated by $\mathbf{102}_\Delta$, navigation sensor $\mathbf{116}a_\Delta$ has coordinate $(X_1+\Delta X_1, Y_1+\Delta Y_1)$ and navigation sensor 116*b* has coordinates $(X_2+\Delta X_2, Y_2+\Delta Y_2)$. The original and repositioned coordinate data is processed by processor 118 to determine a continued path of movement across print media 126.

Non-planar surfaces can also be printed on using print system 100. For example, printing could occur on fabrics, skin, or other type of print surface. In one example in which non-planar printing is desired, two pairs of distance sensors 106*a*, 106*b* are positioned on print media 126. Other quantities of distance sensors 106*a*, 106*b* can also be used. Vertical surfaces, such as vertical sides of containers or walls, for example, can be printed on using print system 100.

Figure 5:
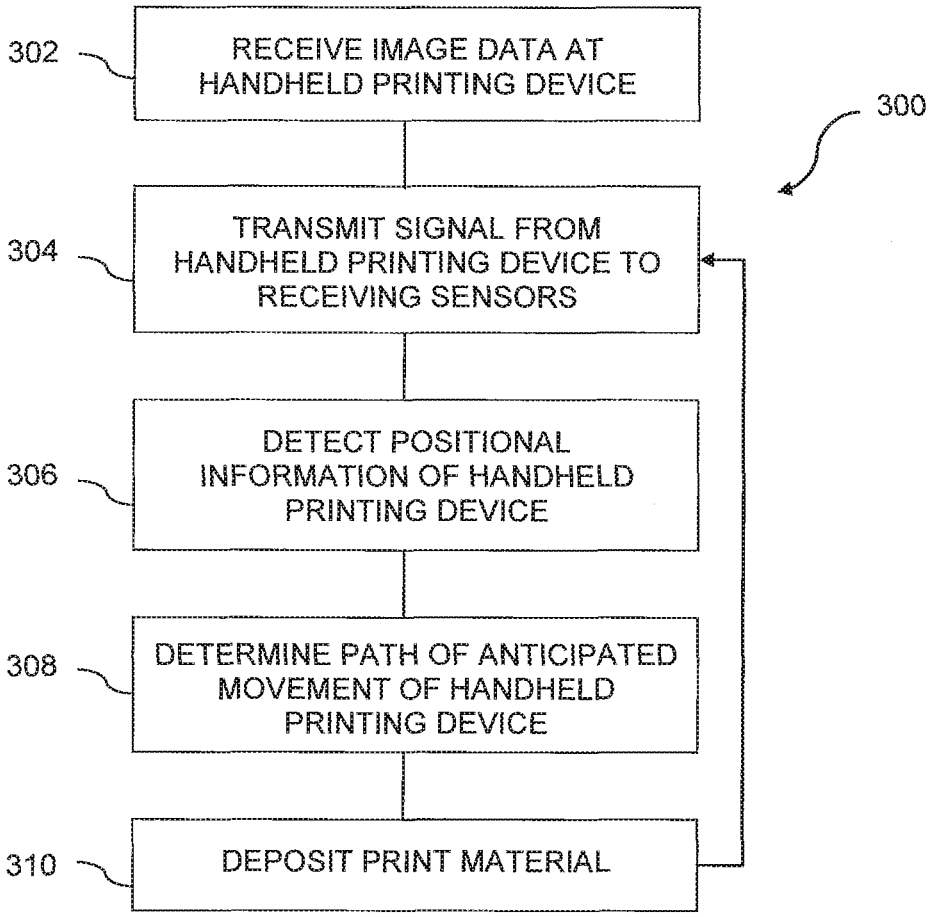
FIG. 5 is a flow diagram of a method of mobile printing in accordance with aspects of the present disclosure.

FIG. 5 illustrates an example method of printing 300. At 302, image data is received at a handheld printing device positioned on a print media. At 304, a signal is transmitted from handheld printing device to receiving sensors on distance sensing module positioned on print media at a location separate from handheld printing device to determine location and position movement of handheld printing device. At 306, rotation and acceleration of handheld printing device is detected with navigation sensors positioned on handheld printing device as handheld printing device is manually moved across print media. At 308, a path of anticipated movement of handheld printing device is determined based on sensed location and position movement and detected rotation and acceleration of handheld printing device as handheld printing device is manually moved across print media. At 310, print material is deposited within print zone according to a print request and determined path of anticipated movement. The method of printing 300 continues by repeating steps 304 through 310 until the desired print image has been transferred (i.e., printed) onto print media.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A mobile printing system, comprising:

a handheld printing device including at least two navigation sensors, a distance sensor transmitter, a processor, and a print nozzle; and a distance sensing module including at least two distance sensors, the distance sensing module to be mountable to a print media at a distance from the handheld printing device, the distance sensing module to sense positional data of the handheld printing device;

wherein the processor determines current, past, and anticipated positions of the handheld printing device based on positional data information received from the distance sensing module and navigation information received from the at least two navigation sensors and controls the handheld printing device to cause print fluid to be dispensed from the print nozzle according to a print request and the anticipated positions of the handheld printing device.

2. The mobile printing system of claim 1, wherein the distance sensors detect ultrasonic waves emitted by the transmitter.

3. The mobile printing system of claim 1, wherein the receivers are ultrasonic.

4. The mobile printing system of claim 1, wherein the at least two navigation sensors comprise:

two high speed optical sensors.

5. The mobile printing system of claim 1, wherein the at least two navigation sensors are attached to the mobile printing device at a fixed distance.

6. The mobile printing system of claim 1, wherein the processor is to determine a rotation angle, speed, and acceleration of the mobile printing device based on positional data detected by the at least two distance sensors and the at least two navigation sensors.

7. A mobile printer, comprising:

a housing formed to be handheld and operated across a print media with a single hand of a user;

at least two navigation sensors fixedly positioned within the housing to detect rotational movement, speed, and acceleration of the mobile printer;

a transmitter to transmit ultrasound waves to remote ultrasound sensors;

an array of print nozzles; and a processor to determine position and motion of the mobile printer and determine anticipated movement based on rotational movement, speed, and acceleration information from at least two navigation sensors and to control the mobile printer to cause ink to be dispensed from the array of print nozzles to deposit ink on the print media according to a print request and the anticipated movement.

8. The mobile printer of claim 7, wherein the array of print nozzles are rotational.

9. The mobile printer of claim 7, wherein the at least two navigation sensors are optical.

10. The mobile printer of claim 7, wherein the array of print nozzles are arranged in a non-linear, non-gridded arrangement.

11. A method of printing, comprising:

receiving image data at a handheld printing device positioned on a print media;

transmitting a signal from the handheld printing device to receiving sensors on a distance sensing module positioned on the print media at a location separate from the handheld printing device to determine location and position movement of the handheld printing device;

detecting rotation and acceleration of the handheld printing device with navigation sensors positioned on the handheld printing device as the handheld printing device is manually moved across the print media;

determining a path of anticipated movement of the handheld printing device based on sensed location and position movement and detected rotation and acceleration of the handheld printing device as the handheld printing device is manually moved across the print media; and depositing print material within the print zone according to a print request and the determined path of anticipated movement.

12. The method of claim 11, comprising:

automatically interrupting the deposit of printing material onto the print media upon sensing the handheld printing device exiting a print zone defined by the distance sensing module.

13. The method of claim 12, comprising:

automatically restarting the deposit of printing material onto the print media based on sensed return of the handheld printing device within the print zone.

14. The method of claim 11, wherein manually moving the handheld printing device is in the form of a sweeping back-and-forth movement of the handheld printing device across the print media.

15. The method of claim 11, automatically interrupting the deposit of printing material occurs when the path of anticipated movement is indeterminable based on the sensed location and position movement and the detected rotation and acceleration of the handheld printing device.

* * * * *